US009208719B2

(12) United States Patent
Kim et al.

(10) Patent No.: US 9,208,719 B2
(45) Date of Patent: Dec. 8, 2015

(54) DISPLAY DEVICE AND ACTIVE MATRIX DRIVING METHOD THEREOF

(75) Inventors: Kwang-Hae Kim, Yongin (KR); Kwan-Wook Jung, Yongin (KR); Hun-Tae Kim, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 586 days.

(21) Appl. No.: 13/206,419

(22) Filed: Aug. 9, 2011

(65) Prior Publication Data

US 2012/0146979 A1 Jun. 14, 2012

(30) Foreign Application Priority Data

Dec. 13, 2010 (KR) ..... 10-2010-0126986

(51) Int. Cl.
*G09G 3/32* (2006.01)

(52) U.S. Cl.
CPC ..... *G09G 3/3233* (2013.01); *G09G 3/3266* (2013.01); *G09G 2300/0819* (2013.01); *G09G 2300/0852* (2013.01); *G09G 2300/0861* (2013.01); *G09G 2310/062* (2013.01)

(58) Field of Classification Search
CPC ..... G09G 3/3233; G09G 3/3225
USPC ..... 345/82
See application file for complete search history.

(56) References Cited

U.S. PATENT DOCUMENTS

2002/0195968 A1* 12/2002 Sanford et al. ..... 315/169.3
2005/0206590 A1* 9/2005 Sasaki et al. ..... 345/76
2005/0219169 A1* 10/2005 Chung et al. ..... 345/76
2005/0259093 A1* 11/2005 Osame et al. ..... 345/204
2006/0001620 A1* 1/2006 Choi ..... 345/76
2006/0077134 A1* 4/2006 Hector et al. ..... 345/76
2008/0088546 A1* 4/2008 Takasugi et al. ..... 345/76
2008/0117147 A1* 5/2008 Iida et al. ..... 345/76
2008/0198103 A1* 8/2008 Toyomura et al. ..... 345/77
2009/0115709 A1* 5/2009 Yamashita et al. ..... 345/76
2009/0184898 A1* 7/2009 Yamashita et al. ..... 345/76
2009/0284519 A1* 11/2009 Kim et al. ..... 345/213
2010/0039411 A1* 2/2010 Yatabe et al. ..... 345/204
2010/0245334 A1* 9/2010 Minami ..... 345/213
2011/0063266 A1* 3/2011 Chung et al. ..... 345/205

(Continued)

FOREIGN PATENT DOCUMENTS

KR 10-2009-0123562 A 12/2009
KR 10-2010-0069963 A 6/2010

*Primary Examiner* — Claire X Pappas
*Assistant Examiner* — Robert Stone
(74) *Attorney, Agent, or Firm* — Knobbe, Martens, Olson & Bear, LLP

(57) ABSTRACT

A driving method of a display device is disclosed. According to one aspect, the method includes applying a first voltage of a predetermined level to an anode of a plurality of organic light emitting diodes (OLEDs) included in a plurality of pixels. A plurality of driving transistors are driven to be connected to the plurality of OLEDs. The method further includes transmitting a first power source voltage of a logic high level to the anode of the plurality of OLEDs as a threshold voltage to compensate a threshold voltage of the plurality of driving transistors, and applying a data voltage to a plurality of pixels as a data writing step turning on a plurality of driving transistors. The second power source voltage applied to the cathode of the plurality of OLEDs is changed to a second voltage of the logic low level in a state in which a plurality of driving transistors are turned on. In the turned on state, light is emitted from the plurality of OLEDs.

2 Claims, 8 Drawing Sheets

(56) References Cited

U.S. PATENT DOCUMENTS

2011/0069058 A1* 3/2011 Chung et al. ..... 345/212
2012/0105408 A1* 5/2012 Kang ..... 345/211
2012/0139961 A1* 6/2012 Choi ..... 345/690

* cited by examiner

DISPLAY DEVICE AND ACTIVE MATRIX DRIVING METHOD THEREOF

CROSS-REFERENCE TO RELATED APPLICATIONS

This application claims priority to and the benefit of Korean Patent Application No. 10-2010-0126986 filed in the Korean Intellectual Property Office on Dec. 13, 2010, the entire contents of which are incorporated herein by reference.

BACKGROUND

1. Field

The disclosed technology relates to a display device and a driving method thereof. More particularly, the disclosed technology relates to a display device configured to expand an emitting time of a pixel in a simultaneous light emitting method, and a driving method thereof.

2. Description of the Related Technology

Recently, a variety of flat panel displays that can reduce weight and size of display components, as well as reduce drawbacks of cathode ray tubes have been developed. Technology used in flat panel displays include liquid crystal displays (LCDs), field emission displays (FEDs), plasma display panels (PDPs), and organic light emitting diode (OLED) displays.

A flat panel display generally includes a display panel including a number of pixels arranged in a matrix or array format. The display panel also includes a number of scan lines in a row direction and a number of data lines in a column direction. The scan lines and the data lines intersect are configured such that they intersect in an array. The pixels are driven by scan signals and data signals transmitted through the corresponding scan lines and data lines of the array.

A flat panel display may be classified as either a passive matrix light emitting display device and an active matrix light emitting display device according to a driving method thereof. Among them, the active matrix type that selectively turns on/off the pixels is primarily relied upon to provide increased resolution, contrast, and operation speed.

The active matrix type light emitting display device may be driven according to a driving method including a data writing period inputting image data to a number of pixels, a reset period wholly resetting the pixels before the data writing period, and a threshold voltage compensation period wholly compensating a deviation of a threshold voltage of a driving transistor supplying a current of the organic light emitting diode (OLED). Furthermore, this driving method includes a light emitting period which is configured to emit light from a number of pixels if the data writing period has ended. The driving method includes a complicated driving method which includes variable control signals and power source voltages transmitted to each of the pixels. The variable control signals and power signals are controlled according to the reset period, the threshold voltage compensation period, the data writing period, and the light emitting period. Furthermore, it is difficult to sufficiently obtain a light emitting period.

The above information disclosed in this Background section is only for enhancement of understanding of the background of the invention and therefore it may contain information that does not form the prior art that is already known in this country to a person of ordinary skill in the art.

SUMMARY OF CERTAIN INVENTIVE ASPECTS

According to some aspects a display device capable of simplifying a signal control and expanding a light emitting time of a pixel in a simultaneous light emitting method, and a driving method thereof are disclosed.

According to one aspect, a method for driving a display device is disclosed. The method includes applying a first voltage of a predetermined level to an anode of a plurality of organic light emitting diodes (OLEDs) included in a plurality of pixels, driving a plurality of driving transistors to be connected to at least one diode of the plurality of OLEDs, and transmitting a first power source voltage of a logic high level to an anode of the plurality of OLEDs to compensate a threshold voltage of the plurality of driving transistors. The method further includes applying a data voltage to a plurality of pixels to write data to the plurality of pixels, thereby turning on the plurality of driving transistors, and changing a second power source voltage applied to the cathode of the plurality of OLEDs to a second voltage corresponding to the logic low level while the plurality of driving transistors are turned on, thereby emitting light from the plurality of OLEDs.

According to another aspect, a display device is disclosed. The display device includes a display unit including a plurality of pixels, a power supply unit configured to supply a first power source voltage and a second power source voltage for driving the plurality of pixels of the display unit, and a threshold voltage compensation driver configured to transmit a compensation control signal to drive a plurality of driving transistors to connect the plurality of organic light emitting diodes (OLEDs) by transmitting the first power source voltage to the plurality of OLEDs included in the plurality of pixels to the display unit. The power supply unit is configured to supply the first power source voltage as the logic high level voltage, supply the second power source voltage as the first voltage of a predetermined level lower than the first power source voltage when the plurality of driving transistors are driven to be connected to the plurality of organic light emitting diodes, and supply the second power source voltage as the second voltage of the logic low level after the data voltage is transmitted to the plurality of pixels for simultaneously emitting light from the plurality of OLEDs.

According to another aspect, a display device is disclosed which includes a display unit including a plurality of pixels, a data driver configured to apply a data voltage to the display unit, a scan driver configured to apply a scan signal for the data voltage to be applied to the display unit, and a threshold voltage compensation driver configured to transmit a compensation control signal to drive a plurality of driving transistors transmitting a first power source voltage to the plurality of organic light emitting diodes (OLEDs) included in the plurality of pixels to the display unit. The scan driver applies a scan signal of a logic high level voltage to the anode of the plurality of OLEDs when the plurality of driving transistors are driven to be connected to the plurality of OLEDs after the scan driver applies a scan signal of a logic low level voltage to the anode of the plurality of OLEDs to reset the anode of the plurality of OLEDs.

According to another aspect, a display device is disclosed which includes a display unit including a plurality of pixels, an initialization driver configured to apply an initialization voltage of a logic low level to an anode of a plurality of organic light emitting diodes (OLEDs) of the plurality of pixels to reset the anode of the plurality of OLEDs, and a threshold voltage compensation driver transmitting a compensation control signal for driving a plurality of driving transistors to connect to the plurality of OLEDs, thereby transmitting a first power source voltage to the anode of the plurality of OLEDs to the display unit. The threshold voltage compensation driver drives the plurality of driving transistors such that the plurality of driving transistors are connected to the OLEDs after the anode of the plurality of OLEDs is reset by the initialization voltage to compensate a threshold voltage of the plurality of driving transistors.

DETAILED DESCRIPTION OF CERTAIN INVENTIVE EMBODIMENTS

Figure 1:
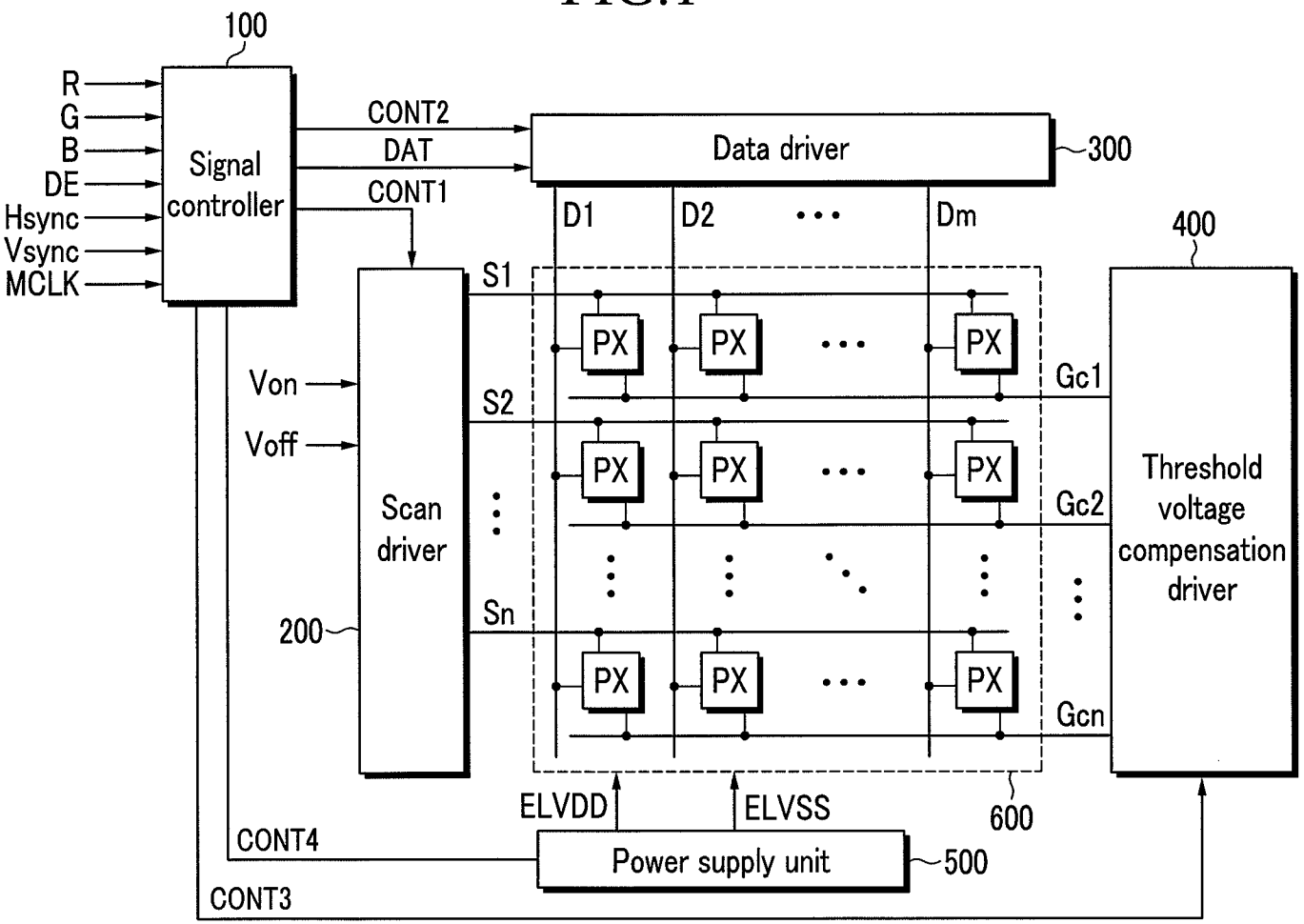
FIG. 1 is a block diagram showing a display device according to some embodiments.

Hereinafter, some exemplary embodiments are described in detail with reference to the accompanying drawings in order for those skilled in the art to be able to readily practice the exemplary embodiments. As those skilled in the art would realize, the described embodiments may be modified in various different ways, all without departing from the spirit or scope of the present invention.

Furthermore, in some exemplary embodiments, constituent elements having the same construction are assigned the same reference numerals and are described in connection with a first exemplary embodiment as a representative example. In the remaining exemplary embodiments, only constituent elements different from those of the first exemplary embodiment are described.

In order to clarify a description of the disclosed embodiments, parts not related to the description are omitted, and the same reference numbers are used throughout the drawing's to refer to the same or like parts.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a block diagram showing a display device according to some embodiments. Referring to FIG. 1, a display device includes a signal controller 100, a scan driver 200, a data driver 300, a threshold voltage compensation driver 400, a power supply unit 500, and a display unit 600.

The signal controller 100 receives video signals R, G, and B that are inputted from an external device, and an input control signal that controls display of the video signals. The video signals R, G, and B include values of a luminance of each pixel PX. The luminance has a grayscale having a predetermined number, for example, $1024=2^{10}$, $256=2^{8}$ or $64=2^{6}$. Examples of the input control signal include a vertical synchronization signal Vsync, a horizontal synchronization signal Hsync, a main clock signal MCLK, and a data enable signal DE.

The signal controller 100 appropriately processes the input video signals R, G, and B for the operation condition of the display unit 600 and the data driver 300 on the basis of the input video signals R, G, and B and the input control signal, and generates a scan control signal CONT1, a data control signal CONT2, a threshold voltage compensation control signal CONT3, a power source control signal CONT4, and an image data signal DAT. The signal controller 100 transmits the scan control signal CONT1 to the scan driver 200. The signal controller 100 transmits the data control signal CONT2 and the image data signal DAT to the data driver 300. The signal controller 100 transmits the threshold voltage compensation control signal CONT3 to the threshold voltage compensation driver 400. The signal controller 100 transmits the power source control signal CONT4 to the power supply unit 500.

The display unit 600 includes a plurality of scan lines S1-Sn, a plurality of data lines D1-Dm, a plurality of compensation lines Gc1-Gcn, and a plurality of pixels PX connected to the plurality of signal lines S1-Sn, D1-Dm, and Gc1-Gcn. The pixels PX are arranged in an approximate matrix format. The plurality of scan lines S1-Sn are extended in a row direction and are in parallel with each other, and the plurality of data lines D1-Dm are extended in a column direction and are in parallel with each other. A plurality of compensation lines Gc1-Gcn are extended in the row direction and are in parallel with each other. A plurality of compensation lines Gc1-Gcn may also be extended in the column direction in parallel with each other.

The scan driver 200 is connected to a plurality of scan lines S1-Sn, and applies scan signals that include a combination of gate-on voltage Von that turns on the switching transistor according to the scan control signal CONT1 and a gate-off voltage Voff that turns off the switching transistor. The scan control signal CONT1 is provided to a plurality of scan lines S1-Sn. The scan driver 200 may sequentially apply the scan signal to a plurality of scan lines S1-Sn. The scan driver 200 applies the scan signal to a plurality of scan lines S1-Sn for the data signal to be applied to a plurality of pixels PX. The scan driver 200 may sequentially apply the scan signal to a plurality of scan lines S1-Sn.

The data driver 300 is connected to a plurality of data lines D1-Dm and selects gray voltages according to the image data signal DAT. The data driver 300 applies the gray voltage selected according to the data control signal CONT2 to a plurality of data lines D1-Dm as the data signal.

The threshold voltage compensation driver 400 is connected to a plurality of compensation lines Gc1-Gcn, and applies a compensation control signal including a combination of a logic high level voltage and a logic low level voltage to a plurality of compensation lines Gc1-Gcn according to the threshold voltage compensation control signal CONT3. The threshold voltage compensation driver 400 may simultaneously apply the compensation control signal to a plurality of compensation lines Gc1-Gcn.

The power supply unit 500 supplies the first power source voltage ELVDD and the second power source voltage ELVSS to supply power to a plurality of pixels to the display unit 600. The first power source voltage ELVDD corresponds to a logic high level voltage and the second power source voltage ELVSS corresponds to a logic low level voltage. The power supply unit 500 may change the second power source voltage ELVSS into the first voltage of the logic high level and the second voltage of the logic low level according to the power source control signal CONT4 and supply it to the display unit 600. The first voltage is a voltage having a lower level than the first power source voltage ELVDD.

Each driving device 100, 200, 300, 400, and 500 may be directly mounted on the display unit 600 in the form of at least one integrated circuit chip, mounted on a flexible printed circuit film, attached to the display unit 600 in the form of a tape carrier package (TCP), or mounted on a separate printed circuit board (PCB). Alternatively, they may be integrated in the display unit 600 together with the signal lines S1-Sn, D1-Dm, and Gc1-Gcn.

The display device according to some embodiments may be driven by a simultaneous light emitting method. The simultaneous light emitting method may include a data writing period inputting an image data to a plurality of pixels and a light emitting period simultaneously driving the plurality of pixels such that light is emitted from all of the driven pixels simultaneously. A reset period is provided for the simultaneous light emitting method to wholly reset a plurality of pixels according to the simultaneous light emitting driving signals of the pixels. A threshold voltage compensation period is also provide for compensating a deviation of a threshold voltage of a driving transistor supplying a current to the organic light emitting diode (OLED). The simultaneous light emitting method is a driving method suitable to be applied to a large-sized display panel. However, the simultaneous light emitting method has a drawback that the light emitting period displaying the images by the reset period, the threshold voltage compensation period, and the data writing period is about 42%. Furthermore, the signal control for driving the display is complicated.

Next, a pixel capable of simplifying the signal control and expanding the light emitting time in a simultaneous light emitting method and a driving method thereof will be described.

Figure 2:
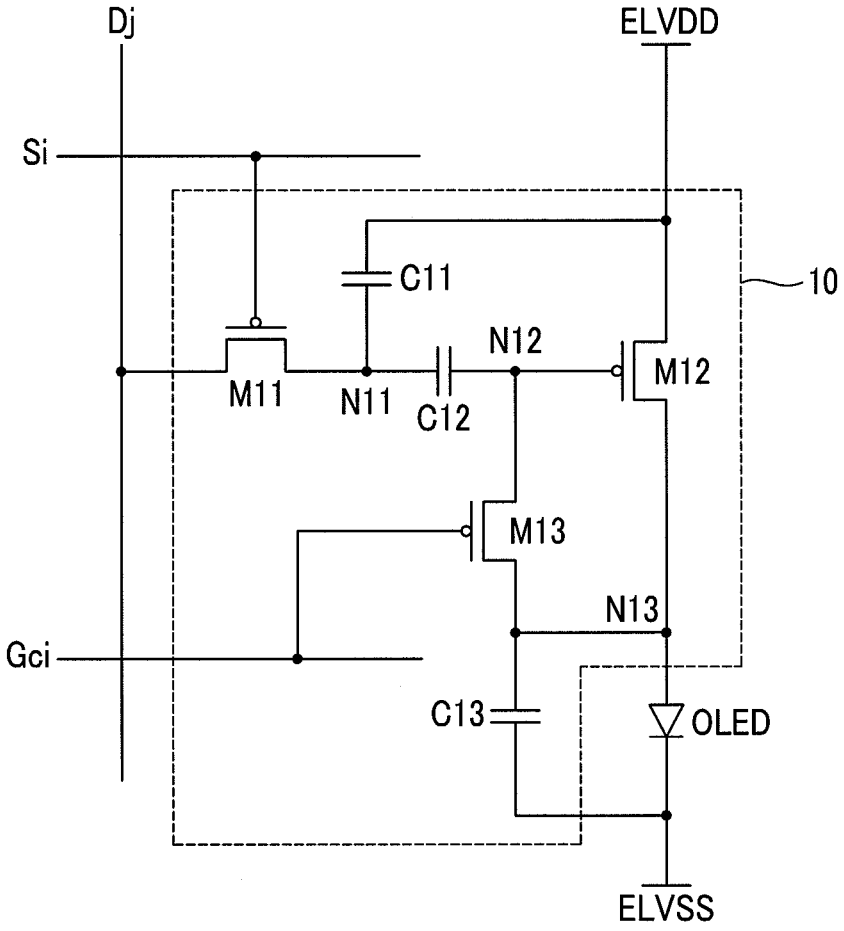
FIG. 2 is a circuit diagram showing a pixel according to some embodiments.

FIG. 2 is a circuit diagram showing a pixel according to some embodiments.

Referring to FIG. 2, a pixel PX of the display device includes an organic light emitting diode OLED and a pixel circuit 10 to control the organic light emitting diode OLED. The pixel circuit 10 includes a switching transistor M11, a driving transistor M12, a threshold voltage compensation transistor M13, a first sustain capacitor C11, a second sustain capacitor C12, and a third sustain capacitor C13.

The switching transistor M11 includes the gate electrode connected to the scan line Si, one terminal connected to the data line Dj, and the other terminal connected to the first node N11. The switching transistor M11 is turned on according to the scan signal applied to the scan line Si such that the data signal applied to the data line Dj is transmitted to the first node N11.

The first sustain capacitor C11 includes one terminal connected to a terminal of the first power source voltage ELVDD and the other terminal connected to the first node N11. The first sustain capacitor C11 is charged with the data voltage applied through the data line Dj and maintains the data voltage after the switching transistor M11 is turned off.

The second sustain capacitor C12 includes one terminal connected to the first node N11 and the other terminal connected to a second node N12. The second sustain capacitor C12 maintains the gate voltage formed at the second node N12 after the switching transistor M11 is turned off.

The driving transistor M12 includes the gate electrode connected to the second node N12, one terminal connected to the terminal of the first power source voltage ELVDD, and the other terminal connected to the third node N13. The driving transistor M12 controls the current flowing in the organic light emitting diode (OLED) according to the gate voltage formed at the second node N12 corresponding to the data voltage applied to the first node N11.

The threshold voltage compensation transistor M13 includes a gate electrode connected to the compensation lines Gci, one terminal connected to the second node N12, and the other terminal connected to the third node N13. The threshold voltage compensation transistor M13 diode-connects the driving transistor M12 to compensate the threshold voltage of the driving transistor M12.

The third sustain capacitor C13 includes one terminal connected to the third node N13 and the other terminal connected to the terminal of the second power source voltage ELVSS. The third sustain capacitor C13 is a parasitic capacitor having a very small capacitance relative to the first sustain capacitor C11 and the second sustain capacitor C12.

The organic light emitting diode OLED includes an anode connected to the third node N13 and a cathode connected to the terminal of the second power source voltage ELVSS.

The other terminal of the switching transistor M11, the other terminal of the first sustain capacitor C11, and one terminal of the second sustain capacitor C12 are connected to the first node N11. The other terminal of the second sustain capacitor C12, the gate electrode of the driving transistor M12, and one terminal of the threshold voltage compensation transistor M13 are connected to the second node N12. The other terminal of the driving transistor M12, the other terminal of the threshold voltage compensation transistor M13, one terminal of the third sustain capacitor C13, and the anode of the organic light emitting diode OLED are connected to the third node N13.

The switching transistor M11, the driving transistor M12, and the threshold voltage compensation transistor M13 may be p-channel field effect transistors. Here, the gate-on voltage turning on the switching transistor M11, the driving transistor M12, and the threshold voltage compensation transistor M13 is a logic low level voltage, and the gate-off voltage turning them off is a logic high level voltage.

Here, the switching transistor M11, the driving transistor M12, and the threshold voltage compensation transistor M13 are configured as p-channel field effect transistors. However at least one of the switching transistor M11, the driving transistor M12, and the threshold voltage compensation transistor M13 may be an n-channel field effect transistor, wherein the gate-on voltage for turning on the n-channel electric field effect transistor is the logic high voltage, and the gate-off voltage for turning off the n-channel field effect transistor is the logic low voltage.

The organic light emitting diode OLED may emit light of one of the primary colors. The primary colors include, for example, three primary colors of red, green, and blue. A desired color is displayed with a spatial or temporal sum of the three primary colors. In this case, the organic light emitting diode (OLED) may partially emit white light, and accordingly luminance is increased. Alternatively, the organic light emitting diodes (OLEDs) of all pixels PX may emit white light, and some of the pixels PX may further include a color filter (not shown) that changes white light emitted from the organic light emitting diodes (OLEDs) to light of one of the primary colors.

Next, the driving method of the display device including the pixel shown in FIG. 2 will be described.

Figure 3:
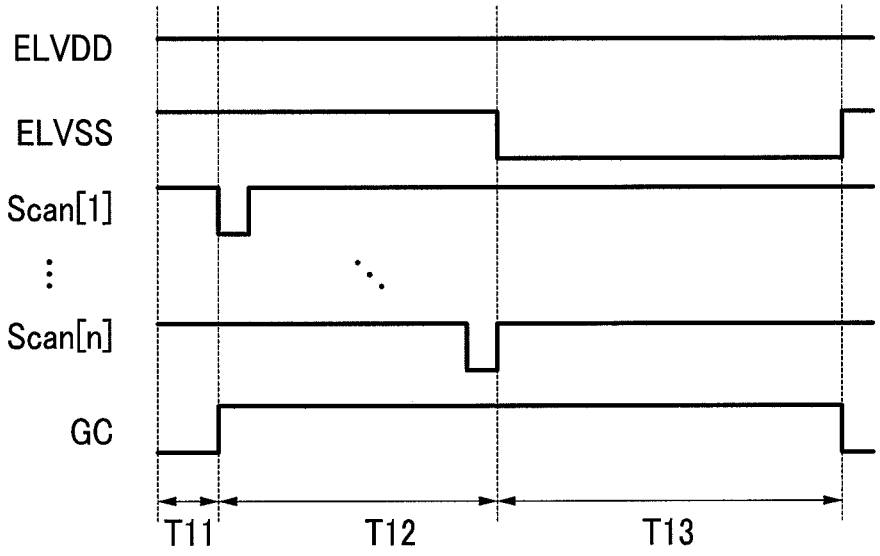
FIG. 3 is a timing diagram showing a driving method of a display device according to some embodiments.

FIG. 3 is a timing diagram showing a driving method of a display device according to some embodiments.

Referring to FIGS. 1 to 3, a display device according to some embodiments may be driven by a simultaneous light emitting method using a frame including a threshold voltage compensation period T11 compensating a deviation of a threshold voltage of a plurality of pixels, a data writing period T12 writing the data signals to the plurality of pixels, and a light emitting period T13 for simultaneously driving the plurality of pixels to a light emitting state.

In the threshold voltage compensation period T11, the threshold voltage compensation driver 400 applies the compensation control signal GC of the logic low level to the gate electrode of the threshold voltage compensation transistor M13 in each pixel such that the threshold voltage compensation transistor M13 is turned on. Here, the power supply unit 500 applies the voltage of the logic high level as the first power source voltage ELVDD and the first voltage having a predetermined lower level than the first power source voltage ELVDD as the second power source voltage ELVSS. For example, when the first power source voltage ELVDD is 13V, the first voltage may be 11V, which is lower than the first power source voltage ELVDD by about 2V. The first voltage is a voltage having a level of a degree such that the current does not flow in the organic light emitting diode OLED by the voltage difference from the first power source voltage ELVDD. The third sustain capacitor C13 is the parasitic capacitor having a very small capacitance relative to the first sustain capacitor C11 and the second sustain capacitor C12 such that the voltage difference (e.g., 2V) between the first power source voltage ELVDD and the second power source voltage ELVSS is caught by the first sustain capacitor C11 and the second sustain capacitor C12. Accordingly, the first voltage is formed at the third node N13. That is, the anode of the organic light emitting diode OLED is applied with the first voltage, and the voltage supplied by the data signal that is previously input to the organic light emitting diode OLED is reset. The first voltage is also formed at the second node N12 according to the turn-on state of the threshold voltage compensation transistor M13. As a result, and the driving transistor M12 is diode-connected such that the threshold voltage of the driving transistor M12 is compensated. That is, when the driving transistor M12 is diode-connected, the anode of the organic light emitting diode OLED is applied with the first voltage by the second power source voltage ELVSS.

In the data writing period T12, the scan driver 200 sequentially applies the scan signals Scan[1]-Scan[n] of the logic low level to a plurality of scan lines S1-Sn. Here, the data driver 300 applies the data voltage corresponding to the image data signal to the pixel array applied with the scan signal of the gate-on voltage through the plurality of data lines D1-Dm. The threshold voltage compensation driver 400 applies the compensation control signal GC of the logic high level to turn off the threshold voltage compensation transistor M13 of each pixel. The power supply unit 500 maintains the first power source voltage ELVDD as the logic high level voltage and the second power source voltage ELVSS as the first voltage. The switching transistor M11 of each pixel is turned on by the scan signal of the logic low level, and the data voltage is applied to the first node N11. The data voltage is stored to the first sustain capacitor C11. The gate voltage corresponding to the data voltage is formed at the second node N12 by coupling the second sustain capacitor C12. The driving transistor M12 is turned on by the gate voltage formed at the second node N12. The anode of the organic light emitting diode OLED may be applied with the first power source voltage ELVDD corresponding to the data voltage, and the cathode of the organic light emitting diode OLED is applied with the first voltage. However, in this state the organic light emitting diode OLED does not emit light. Generally, current flows through the organic light emitting diode OLED when the voltage difference between the anode and the cathode according to the light emitting color is in the range of about 2.5V to 3V. However the first voltage has the voltage difference of about 2V for the first power source voltage ELVDD such that the current does not flow in the organic light emitting diode OLED.

In the light emitting period T13, the power supply unit 500 changes the second power source voltage ELVSS to the second voltage of the logic low level and applies it to the cathode of the organic light emitting diode OLED. The scan driver 200 applies the scan signal Scan[1]-Scan[n] of the logic high level to a plurality of scan lines S1-Sn, and the threshold voltage compensation driver 400 applies the compensation control signal GC of the logic high level to a plurality of compensation lines Gc1-Gcn. The driving transistor M12 maintains the turned-on state by the gate voltage that is maintained at the second node N12. The second power source voltage ELVSS is changed into the second voltage of the logic low level such that the current corresponding to the data voltage flows to the organic light emitting diode OLED through the driving transistor M12, and thereby the organic light emitting diode OLED emits the light with the brightness corresponding to the data voltage. That is, in the light emitting period T13, a plurality of pixels simultaneously emit the light to display the image data.

As described above, the second power source voltage ELVSS is applied as the first voltage of a lower level than the first power source voltage ELVDD. The lower level is to a degree such that a current does not flow in the organic light emitting diode OLED, and thereby the threshold voltage of the driving transistor M12 of each pixel may not only be compensated in the threshold voltage compensation period T11, but also the voltage of the anode of the organic light emitting diode OLED may be reset as the first voltage. Accordingly, an additional reset period to reset the voltage of the anode of the organic light emitting diode OLED is not necessary, and thereby the signal control may be simplified and the light emitting time of the pixel may be expanded in the simultaneous light emitting method.

Next, a pixel and a driving method according to some embodiments capable of simplifying the signal control and expanding the light emitting time in the simultaneous light emitting method will be described.

Figure 4:
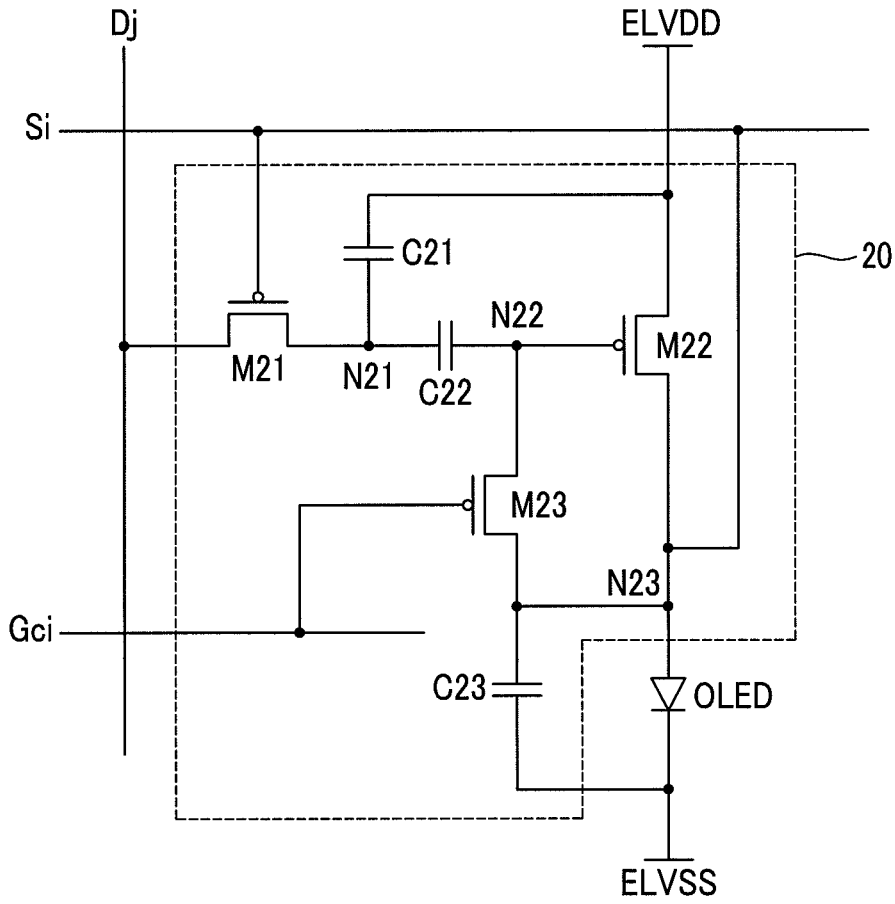
FIG. 4 is a circuit diagram showing a pixel according to some embodiments.

FIG. 4 is a circuit diagram showing a pixel according to some embodiments.

Referring to FIG. 4, the pixel PX of the display device includes an organic light emitting diode OLED and a pixel circuit 20 to control the organic light emitting diode OLED. The pixel circuit 20 includes a switching transistor M21, a driving transistor M22, a threshold voltage compensation transistor M23, a first sustain capacitor C21, a second sustain capacitor C22, and a third sustain capacitor C23.

The switching transistor M21 includes the gate electrode connected to the scan line Si, one terminal connected to the data line Dj, and the other terminal connected to the first node N21. The switching transistor M21 is turned on according to the scan signal applied to the scan line Si such that the data signal applied to the data line Dj is transmitted to the first node N21.

The first sustain capacitor C21 includes one terminal connected to the terminal of the first power source voltage ELVDD and the other terminal connected to the first node N21. The first sustain capacitor C21 is charged with the data voltage applied through the data line Dj and maintains the data voltage after the switching transistor M21 is turned off.

The second sustain capacitor C22 includes one terminal connected to the first node N21 and the other terminal connected to the second node N22. The second sustain capacitor C22 maintains the gate voltage formed at the second node N22 after the switching transistor M21 is turned off.

The driving transistor M22 includes the gate electrode connected to the second node N22, one terminal connected to the terminal of the first power source voltage ELVDD, and the other terminal connected to the third node N23. The driving transistor M22 controls the current flowing to the organic light emitting diode OLED according to the gate voltage formed at the second node N22 corresponding to the data voltage applied to the first node N21.

The threshold voltage compensation transistor M23 includes the gate electrode connected to the compensation lines Gci, one terminal connected to the second node N22, and the other terminal connected to the third node N23. The threshold voltage compensation transistor M23 diode-connects the driving transistor M22 to compensate the threshold voltage of the driving transistor M22.

The third sustain capacitor C23 includes one terminal connected to the third node N23 and the other terminal connected to the terminal of the second power source voltage ELVSS.

The organic light emitting diode OLED includes the anode connected to the third node N23 and the cathode connected to the terminal of the second power source voltage ELVSS.

The other terminal of the switching transistor M21, the other terminal of the first sustain capacitor C21, and one terminal of the second sustain capacitor C22 are connected to the first node N21. The second node N22 is connected to the other terminal of the second sustain capacitor C22, the gate electrode of the driving transistor M22, and one terminal of the threshold voltage compensation transistor M23. The third node N23 is connected to the other terminal of the driving transistor M22, the other terminal of the threshold voltage compensation transistor M23, one terminal of the third sustain capacitor C23, the anode of the organic light emitting diode OLED, and the scan line Si.

The pixel illustrated in FIG. 4 differs from the pixel of FIG. 2 in that the third node N23 is connected to the scan line Si. Accordingly, the anode of the organic light emitting diode OLED is applied with the scan signal.

The switching transistor M21, the driving transistor M22, and the threshold voltage compensation transistor M23 may be the p-channel field effect transistors. Here, the gate-on voltage turning on the switching transistor M21, the driving transistor M22, and the threshold voltage compensation transistor M23 is a logic low level voltage, and the gate-off voltage turning off the transistors M21, M22, and M23 is a logic high level voltage.

Here, the switching transistor M21, the driving transistor M22, and the threshold voltage compensation transistor M23 are p-channel field effect transistors. However at least one of the switching transistor M21, the driving transistor M22, and the threshold voltage compensation transistor M23 may be an n-channel field effect transistor, wherein the gate-on voltage for turning on the n-channel electric field effect transistor is the logic high voltage, and the gate-off voltage for turning it off is the logic low voltage.

Next, the driving method of the display device including the pixel of FIG. 4 will be described.

Figure 5:
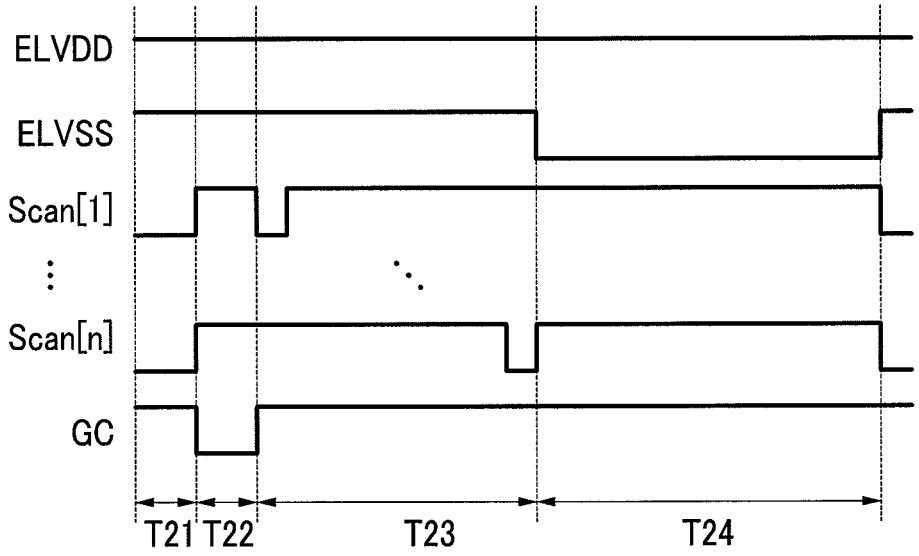
FIG. 5 is a timing diagram showing a driving method of a display device according to some embodiments.

FIG. 5 is a timing diagram of a driving method of a display device according to some embodiments.

Referring to FIGS. 1, 4 and 5, a display device according to some embodiments may be driven by a simultaneous light emitting method using a frame including a reset period T21 resetting a plurality of pixels, a threshold voltage compensation period T22 compensating a deviation of a threshold voltage of a plurality of pixels, a data writing period T23 writing the data signals to the plurality of pixels, and a light emitting period T24 simultaneously light emitting the plurality of pixels.

In the reset period T21, the scan driver 200 applies the scan signals Scan[1]-Scan[n] of the logic low level which is configured to reset the anode of the organic light emitting diode OLED to a voltage of the plurality of scan lines S1-Sn. Here, the threshold voltage compensation driver 400 applies the compensation control signal GC of the logic high level to a plurality of compensation lines Gc1-Gcn, and the power supply unit 500 applies the first power source voltage ELVDD and the second power source voltage ELVSS as the logic high level. The scan signal of the logic low level is transmitted to the third node N23. Accordingly, the anode of the organic light emitting diode OLED is applied with the logic low level voltage, and the organic light emitting diode (OLED) is reset with the voltage by the data signal that is previously input.

In the threshold voltage compensation period T22, the threshold voltage compensation driver 400 applies the compensation control signal GC corresponding to the logic low level to the gate electrode of the threshold voltage compensation transistor M23 in each pixel such that the threshold voltage compensation transistor M23 is turned on. Here, the scan driver 200 applies the scan signal Scan[1]-Scan[n] of the logic high level to a plurality of scan lines S1-Sn, and the power supply unit 500 maintains the first power source voltage ELVDD and the second power source voltage ELVSS as the logic high level. The third node N23 is applied with the scan signals Scan[1]-Scan[n] of the logic high level voltage, and the threshold voltage compensation transistor M23 is turned on such that the second node N22 is driven to the logic high level voltage. That is, the driving transistor M22 is diode-connected such that the threshold voltage is compensated.

In the data writing period T23, the scan driver 200 sequentially applies the scan signals Scan[1]-Scan[n] of the logic low level to a plurality of scan lines S1-Sn. Here, the data driver 300 applies the data voltage corresponding to the image data signal to the pixel array applied with the scan signal of the gate-on voltage through the plurality of data lines D1-Dm. The threshold voltage compensation driver 400 applies the compensation control signal GC of the logic high level to turn off the threshold voltage compensation transistor M23 of each pixel. The power supply unit 500 maintains the first power source voltage ELVDD end the second power source voltage ELVSS as the logic high level voltage. The switching transistor M21 of each pixel is turned on by the scan signal of the logic low level, and the first node N21 is applied with the data voltage. The first sustain capacitor C21 stores the data voltage. The gate voltage corresponding to the data voltage is formed at the second node N22 through coupling the second sustain capacitor C22. The driving transistor M22 is turned on by the gate voltage formed at the second node N22. The first power source voltage ELVDD and the second power source voltage ELVSS are applied as the logic high level voltage such the organic light emitting diode OLED does not emit light.

In the light emitting period T24, the power supply unit 500 changes the second power source voltage ELVSS to the logic low level voltage and applies it to the cathode of the organic light emitting diode OLED. The threshold voltage compensation driver 400 applies the compensation control signal GC of the logic high level to a plurality of compensation lines Gc1-Gcn. The driving transistor M22 maintains the turned-on state by the gate voltage maintained at the second node N22. The second power source voltage ELVSS is changed into the logic low level voltage such that a current corresponding to the data voltage flows to the organic light emitting diode OLED through the driving transistor M22. In this example, the scan driver 200 blocks the scan signals Scan[1]-Scan[n] applied to a plurality of scan lines S1-Sn such that the current flowing into the organic light emitting diode OLED is not influenced. The organic light emitting diode OLED emits light with a brightness corresponding to the data voltage. That is, in the light emitting period T24, a plurality of pixels simultaneously emit light to display the image data.

As described above, the anode of the organic light emitting diode OLED is connected to the scan line Si, and thereby the voltage of the anode of the organic light emitting diode OLED may be reset by a simple signal control. As a result, the light emitting time of the pixel may be expanded in the reset period T21.

Next, a pixel and a driving method according to some embodiments capable of simplifying the signal control and expanding the light emitting time in the simultaneous light emitting method will be described. The pixel configuration will be described by focusing on the differences compared with the display device of FIG. 1, the pixel of FIG. 2, and the driving method of FIG. 3.

Figure 6:
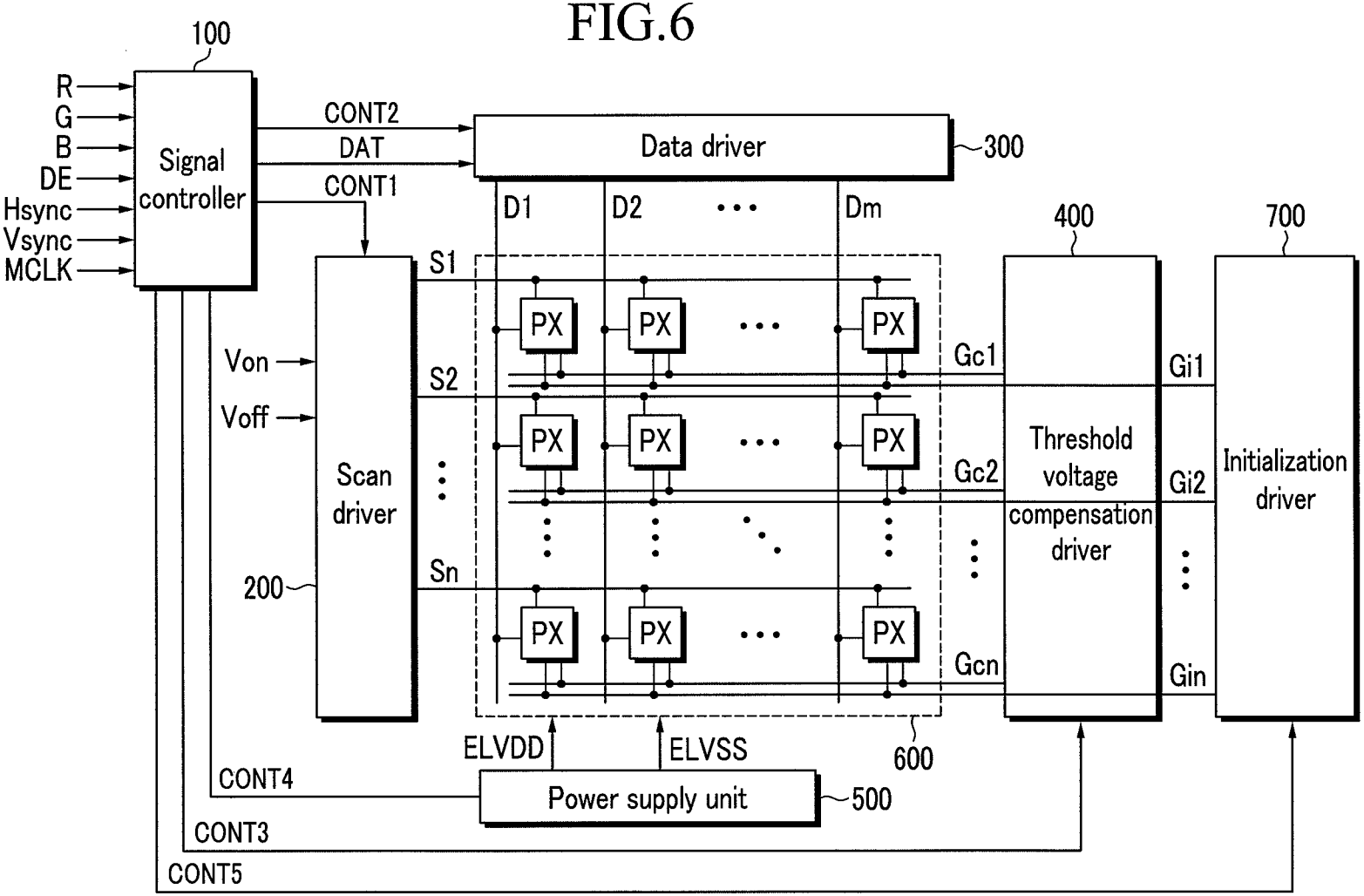
FIG. 6 is a block diagram showing a display device according to some embodiments.

FIG. 6 is a block diagram showing a display device according to some embodiments.

Referring to FIG. 6, the display device includes a signal controller 100, a scan driver 200, a data driver 300, a threshold voltage compensation driver 400, a power supply unit 500, a display unit 600, and an initialization driver 700. As illustrated in FIG. 6, an initialization driver 700 is included which is not included in the display device described with reference to FIG. 1.

The signal controller 100 further generates an initialization control signal CONT5 according to the operation condition of the display unit 600 and the data driver 300 and transmits the initialization control signal CONT5 to the initialization driver 700.

A plurality of pixels PX included in the display unit 600 are connected to a plurality of scan lines S1-Sn, a plurality of data lines D1-Dm, a plurality of compensation lines Gc1-Gcn, and a plurality of initialization lines Gi1-Gin, and are arranged in an approximate matrix form as discussed above. A plurality of initialization lines Gi1-Gin are extended in the row direction and are in parallel with each other. A plurality of initialization lines Gi1-Gin may also be extended in the column direction (not shown) in parallel with each other.

The initialization driver 700 is connected to a plurality of initialization lines Gi1-Gin, and applies an initialization signal including the combination of the logic high level voltage and the logic low level voltage to a plurality of initialization lines Gi1-Gin according to the initialization control signal CONT5. The initialization driver 700 may simultaneously apply the initialization signal to a plurality of initialization lines Gi1-Gin.

Figure 7:
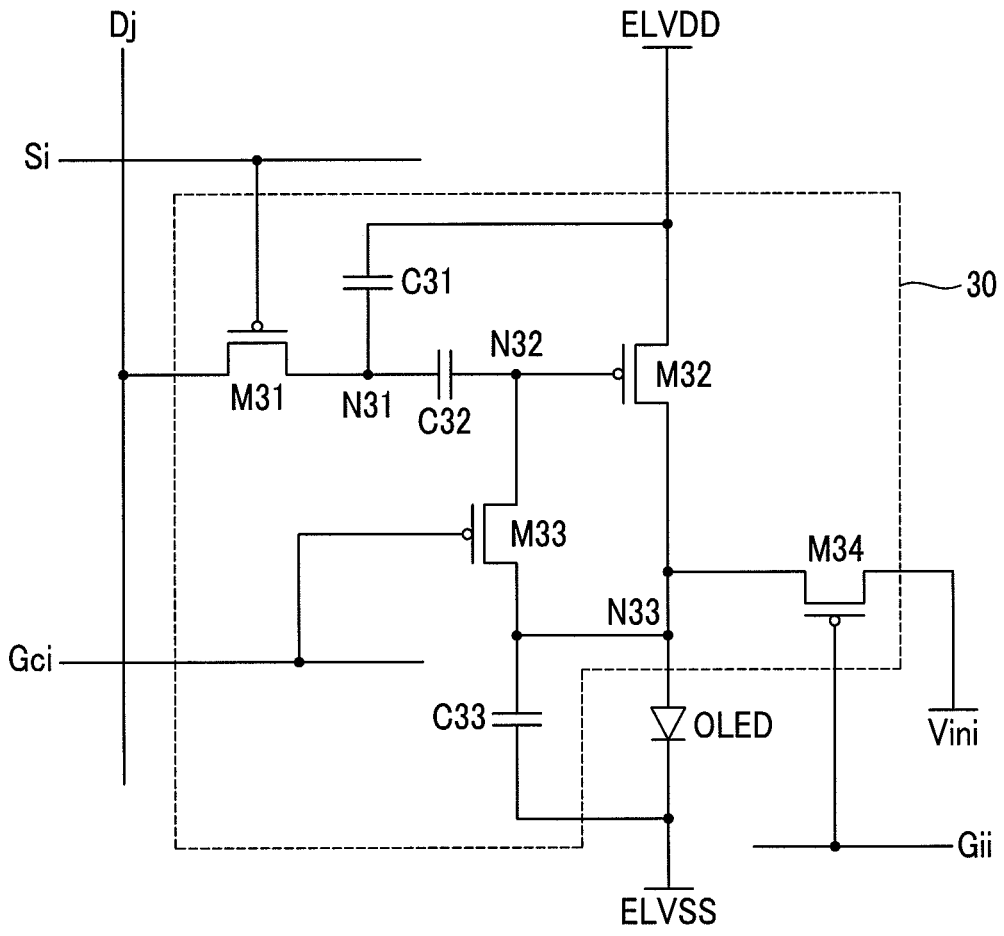
FIG. 7 is a circuit diagram showing a pixel according to some embodiments.

FIG. 7 is a circuit diagram showing a pixel according to some embodiments.

Referring to FIG. 7, the pixel PX of the display device includes the organic light emitting diode OLED and a pixel circuit 30 to control the organic light emitting diode OLED. The pixel circuit 30 includes a switching transistor M31, a driving transistor M32, a threshold voltage compensation transistor M33, an initialization transistor M34, a first sustain capacitor C31, a second sustain capacitor C32, and a third sustain capacitor C33. Compared with the pixel illustrated in FIG. 2, the pixel of FIG. 7 further includes initialization transistor M34.

The switching transistor M31 includes the gate electrode connected to the scan line Si, one terminal connected to the data line Dj, and the other terminal connected to the first node N31. The switching transistor M31 is turned on according to the scan signal applied to the scan line Si such that the data signal applied to the data line Dj is transmitted to the first node N31.

The first sustain capacitor C31 includes one terminal connected to the terminal of the first power source voltage ELVDD and the other terminal connected to the first node N31. The first sustain capacitor C31 is charged with the data voltage applied through the data line Dj and maintains the data voltage after the switching transistor M31 is turned off.

The second sustain capacitor C32 includes one terminal connected to the first node N31 and the other terminal connected to the second node N32. The second sustain capacitor C32 maintains the gate voltage formed at the second node N32 after the switching transistor M31 is turned off.

The driving transistor M32 includes the gate electrode connected to the second node N32, one terminal connected to the terminal of the first power source voltage ELVDD, and the other terminal connected to the third node N33. The driving transistor M32 controls the current flowing in the organic light emitting diode OLED according to the gate voltage formed at the second node N32 corresponding to the data voltage applied to the first node N31.

The threshold voltage compensation transistor M33 includes the gate electrode connected to the compensation lines Gci, one terminal connected to the second node N32, and the other terminal connected to the third node N33. The threshold voltage compensation transistor M33 diode-connects the driving transistor M32 to compensate the threshold voltage of the driving transistor M32.

The initialization transistor M34 includes the gate electrode connected to the initialization lines Gii, one terminal connected to the terminal of the initialization voltage Vini, and the other terminal connected to the third node N33. The initialization transistor M34 transmits the initialization voltage Vini to the third node N33 according to the initialization signal applied to the initialization lines Gii in order to reset the voltage of the anode of the organic light emitting diode OLED.

The third sustain capacitor C33 includes one terminal connected to the third node N33 and the other terminal connected to the terminal of the second power source voltage ELVSS.

The organic light emitting diode OLED includes the anode connected to the third node N33 and the cathode connected to the terminal of the second power source voltage ELVSS.

The first node N31 is connected to the other terminal of the switching transistor M31, the other terminal of the first sustain capacitor C31, and one terminal of the second sustain capacitor C32. The second node N32 is connected to the other terminal of the second sustain capacitor C32, the gate electrode of the driving transistor M32, and one terminal of the threshold voltage compensation transistor M33. The third node N33 is connected to the other terminal of the driving transistor M32, the other terminal of the threshold voltage compensation transistor M33, one terminal of the third sustain capacitor C33, the anode of the organic light emitting diode OLED, and the other terminal of the initialization transistor M34.

The switching transistor M31, the driving transistor M32, the threshold voltage compensation transistor M33, and the initialization transistor M34 may be p-channel field effect transistors. Here, the gate-on voltage turning on the switching transistor M31, the driving transistor M32, the threshold voltage compensation transistor M33, and the initialization transistor M34 is a logic low level voltage, and the gate-off voltage for turning off the transistors M31, M32, M33, and M34 is a logic high level voltage.

Here, the switching transistor M31, the driving transistor M32, the threshold voltage compensation transistor M33, and the initialization transistor M34 are p-channel field effect transistors. However at least one of the switching transistor M31, the driving transistor M32, the threshold voltage compensation transistor M33, and the initialization transistor M34 may be an n-channel field effect transistor, such that the gate-on voltage for turning on the n-channel electric field effect transistor is the logic high voltage, and the gate-off voltage for turning the transistors off is the logic low voltage.

Alternatively, the initialization transistor M34 is respectively included in a subset of the plurality of pixels. For example, the initialization transistor M34 may not be respectively included in a another subset of the plurality of pixels. At least one initialization transistor M34 connected to the terminal of the initialization voltage Vini may be provided outside the display unit 600, and the initialization voltage Vini output from the other terminal of the initialization transistor M34 may be transmitted to the third node N33 of each pixel.

Next, the driving method of the display device including the pixel of FIG. 7 will be described.

Figure 8:
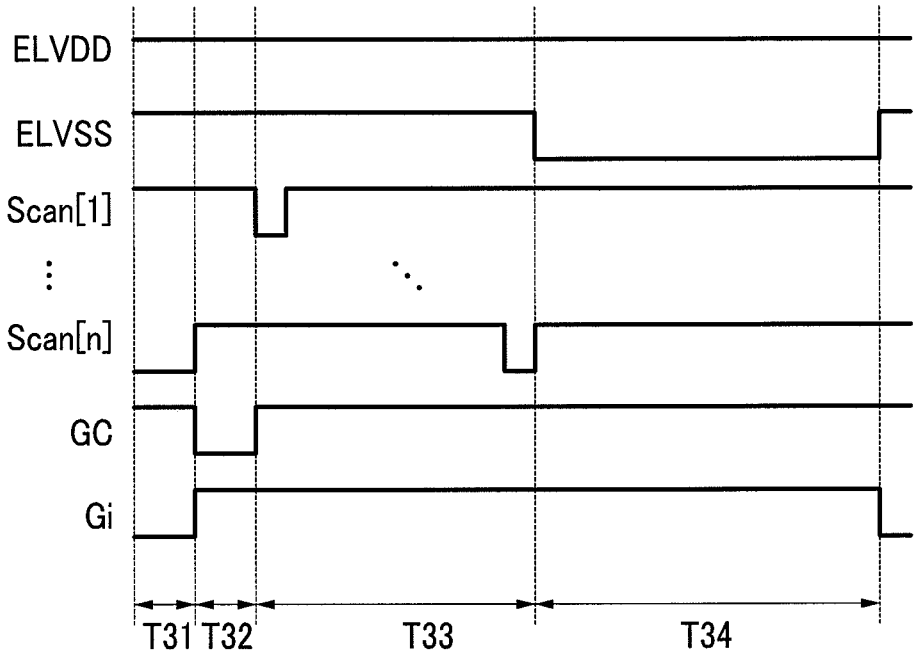
FIG. 8 is a timing diagram showing a driving method of a display device according to some embodiments.

FIG. 8 is a timing diagram of a driving method of a display device according to some embodiments.

Referring to FIGS. 6 to 8, a display device according to some embodiments may be driven by a simultaneous light emitting method using a frame including a reset period T31 resetting a plurality of pixels, a threshold voltage compensation period T32 compensating a deviation of a threshold voltage of a plurality of pixels, a data writing period T33 writing the data signals to the plurality of pixels, and a light emitting period T34 for simultaneously emitting light from the plurality of pixels.

In the reset period T31, the initialization driver 700 applies the initialization signal Gi of the logic low level to reset the anode of the organic light emitting diode OLED to a voltage corresponding to the plurality of initialization lines Gi1-Gin. Here, the threshold voltage compensation driver 400 applies the compensation control signal GC of the logic high level to a plurality of compensation lines Gc1-Gcn, the power supply unit 500 applies the first power source voltage ELVDD and the second power source voltage ELVSS as the logic high level, and the scan driver 200 applies the scan signals Scan[1]-Scan[n] of the logic high level to a plurality of scan lines S1-Sn. The initialization transistor M34 of each pixel is turned on, and the initialization voltage Vini is transmitted to the third node N33. The initialization voltage Vini corresponds to the voltage of the logic low level determined to reset the voltage of the anode of the organic light emitting diode OLED. For example, the initialization voltage Vini may use the voltage within the range of about 1V to 2V. The anode of the organic light emitting diode OLED is applied with the initialization voltage Vini such that the voltage of the data signal that is previously input to the organic light emitting diode OLED is reset.

In the threshold voltage compensation period T32, the threshold voltage compensation driver 400 applies the compensation control signal GC of the logic low level to the gate electrode of the threshold voltage compensation transistor M33 in each pixel such that the threshold voltage compensation transistor M33 is turned on. Here, the scan driver 200 applies the scan signal Scan[1]-Scan[n] of the logic high level to a plurality of scan lines S1-Sn. The initialization driver 700 applies the initialization signal Gi of the logic high level to a plurality of initialization lines Gi1-Gin, and the power supply unit 500 maintains the first power source voltage ELVDD and the second power source voltage ELVSS as the logic high level. According to the turn-on state of the threshold voltage compensation transistor M33, the driving transistor M32 is diode-connected to compensate the threshold voltage.

In the data writing period T33, the scan driver 200 sequentially applies the scan signals Scan[1]-Scan[n] of the logic low level to a plurality of scan lines S1-Sn. Here, the data driver 300 applies the data voltage corresponding to the image data signal to the pixel array applied with the scan signal of the gate-on voltage through the plurality of data lines D1-Dm. The threshold voltage compensation driver 400 applies the compensation control signal GC of the logic high level to turn off the threshold voltage compensation transistor M33 of each pixel. The power supply unit 500 maintains the first power source voltage ELVDD and the second power source voltage ELVSS as the logic high level voltage, and the initialization driver 700 applies the initialization signal Gi of the logic high level to turn off the initialization transistor M34 of each pixel. The switching transistor M31 of each pixel is turned on by the scan signal of the logic low level, and the first node N31 is applied with the data voltage. The first sustain capacitor C31 stores the data voltage. The second node N32 is driven with the gate voltage corresponding to the data voltage through coupling of the second sustain capacitor C32. The driving transistor M32 is turned on by the gate voltage formed at the second node N32. The first power source voltage ELVDD and the second power source voltage ELVSS are applied as the logic high level voltage such the organic light emitting diode OLED does not emit light.

In the light emitting period T34, the power supply unit 500 changes the second power source voltage ELVSS into the logic low level voltage and applies it to the cathode of the organic light emitting diode OLED. The driving transistor M22 maintains the turned-on state by the gate voltage maintained at the second node N22. The second power source voltage ELVSS is changed to the logic low level voltage such that the current corresponding to the data voltage flows to the organic light emitting diode OLED through the driving transistor M32. The organic light emitting diode OLED emits light with a brightness corresponding to the data voltage. That is, in the light emitting period T34, a plurality of pixels simultaneously emit light to display the image data.

As described above, the anode of the organic light emitting diode OLED is connected to the initialization transistor M34 which is configured to transmit the initialization voltage Vini. As a result, the voltage of the anode of the organic light emitting diode OLED may be reset by a simple signal control and the light emitting time of the pixel may be expanded in the reset period T21.

As described above, a driving method of a display device according to some embodiments includes: applying a first voltage of a predetermined level to an anode of a plurality of OLEDs included in a plurality of pixels and diode-connecting a plurality of driving transistors transmitting a first power source voltage of a logic high level to the anode of a plurality of OLEDs as a threshold voltage compensation step. The threshold voltage compensation including compensating a threshold voltage of the plurality of driving transistors. The method further including applying a data voltage to a plurality of pixels as a data writing step, thereby turning on a plurality of driving transistors. The method further includes changing a second power source voltage applied to the cathode of a plurality of OLEDs into a second voltage of the logic low level in a state that a plurality of driving transistors are turned on as a light emitting step for emitting light from the plurality of OLEDs.

The method may further include, in the threshold voltage compensation step, applying the second power source voltage to the cathode of a plurality of organic light emitting diodes OLED as the first voltage. The first voltage may be a lower voltage than the first power source voltage, and the first voltage may be applied to the anode of the OLEDs by the second power source voltage.

According to some embodiments, the first voltage may be a voltage having a level at which a current does not flow in the plurality of organic light emitting diodes OLED by a voltage difference along with the first power source voltage. The second power source voltage applied to the cathode of the plurality of OLEDs in the data writing step may be applied as the first voltage.

The method may further include applying a scan signal corresponding to a logic low level voltage to the anode of the plurality of OLEDs to reset to the anode of the plurality of OLEDs as a reset step.

The threshold voltage compensation step may include applying the scan signal of the logic high level voltage to the anode of the plurality of OLEDs. The first voltage may be a logic high level voltage of the scan signal in the threshold voltage compensation step. The first power source voltage and the second power source voltage may be applied with the logic high level voltage in the data writing step.

The method may further include applying an initialization voltage to the anode of the plurality of OLEDs as a reset step, thereby resetting the anode of the plurality of OLEDs.

The initialization voltage may correspond to a predetermined logic low level voltage to reset the anode of the plurality of OLEDs. The first power source voltage and the second power source voltage may be applied as the logic high level voltage in the data writing step.

According to some embodiments, a display device according includes a display unit including a plurality of pixels, a power supply unit supplying a first power source voltage and a second power source voltage for driving the plurality of pixels to the display unit, and a threshold voltage compensation driver configured to transmit a compensation control signal to diode-connect a plurality of driving transistors. The transistors may be configured to transmit the first power source voltage to the plurality of OLEDs included in the plurality of pixels to the display unit, wherein the power supply unit supplies the first power source voltage as the logic high level voltage, supplies the second power source voltage as the first voltage of a predetermined level lower than the first power source voltage when the plurality of driving transistors are diode-connected, and supplies the second power source voltage as the second voltage of the logic low level after the data voltage is transmitted to the plurality of pixels for simultaneously emitting light from the plurality of OLEDs.

According to some embodiments, the first voltage may be a voltage having a level at which a current does not flow in the plurality of OLEDs by a voltage difference along with the first power source voltage. The anode of the plurality of OLEDs may be applied with the first voltage by the second power source voltage when the plurality of driving transistors are diode-connected.

According to some embodiments, a display device includes a display unit including a plurality of pixels, a data driver applying a data voltage to the display unit, a scan driver applying a scan signal for the data voltage to be applied to the display unit, and a threshold voltage compensation driver configured to transmit a compensation control signal to diode-connect a plurality of driving transistors. The transistors may be configured to transmit a first power source voltage to a plurality of OLEDs included in a plurality of pixels to the display unit, wherein the scan driver applies a scan signal of a logic high level voltage to the anode of the plurality of OLEDs when the plurality of driving transistors are diode-connected after the scan driver applies a scan signal of a logic low level voltage to the anode of the plurality of OLEDs to reset the anode of the plurality of OLEDs.

A display device according to another exemplary embodiment of the present invention includes a display unit including a plurality of pixels; an initialization driver applying an initialization voltage of a logic low level to an anode of a plurality of OLEDs of the plurality of pixels to reset the anode of the plurality of OLEDs; and a threshold voltage compensation driver transmitting a compensation control signal for diode-connecting of a plurality of driving transistors transmitting a first power source voltage to the anode of the plurality of OLEDs to the display unit, wherein the threshold voltage compensation driver diode-connects a plurality of driving transistors after the anode of the plurality of OLEDs is reset by the initialization voltage to compensate a threshold voltage of the plurality of driving transistors.

According to some embodiments described above, signal control of a display device driven by a simultaneous light emitting method may be simplified and light emitting time of a pixel may be expanded.

The drawings and the detailed description of the embodiments described above are examples for the present invention and are provided to explain the present invention. The scope of the present invention described in the claims is not limited thereto. Therefore, it will be appreciated to those skilled in the art that various modifications may be made and other alternative embodiments are available. Accordingly, the scope of the present invention is defined by the spirit and scope of the appended claims.

What is claimed is:

1. A method for driving a display device comprising:

applying a first voltage of a predetermined level to an anode of a plurality of organic light emitting diodes (OLEDs) included in a plurality of pixels;

driving a plurality of driving transistors to be connected to at least one diode of the plurality of OLEDs;

transmitting a first power source voltage of a logic high level to an anode of the plurality of OLEDs to compensate a threshold voltage of the plurality of driving transistors;

applying a data voltage to a plurality of pixels to write data to the plurality of pixels, thereby turning on the plurality of driving transistors;

changing a second power source voltage applied to the cathode of the plurality of OLEDs to a second voltage corresponding to the logic low level while the plurality of driving transistors are turned on, thereby emitting light from the plurality of OLEDs; and applying a scan signal of the logic low level voltage to the anode of the plurality of OLEDs to reset the anode of the plurality of OLEDs, wherein the compensating the threshold voltage of the plurality of driving transistors includes:

applying a scan signal corresponding to a logic high level voltage to the anode of the plurality of OLEDs.

2. The method of claim 1, wherein the first voltage corresponds to a logic high level voltage of the scan signal for compensating the threshold voltage of the plurality of driving transistors.

* * * * *